US008365443B2

(12) United States Patent
Huynh

(10) Patent No.: US 8,365,443 B2
(45) Date of Patent: Feb. 5, 2013

(54) SHOE WITH TRANSVERSE APERTURE AND COVER

(76) Inventor: Chi Huynh, San Dimas, CA (US)

( * ) Notice: Subject to any disclaimer, the term of this patent is extended or adjusted under 35 U.S.C. 154(b) by 296 days.

(21) Appl. No.: 12/781,769

(22) Filed: May 17, 2010

(65) Prior Publication Data

US 2011/0277350 A1 Nov. 17, 2011

(51) Int. Cl.
*A43B 1/10* (2006.01)

(52) U.S. Cl. ..... 36/102; 36/45; 36/54

(58) Field of Classification Search ..... 36/45, 102, 36/77 R, 25 R, 54
See application file for complete search history.

(56) References Cited

U.S. PATENT DOCUMENTS

| | | | | | |
|---|---|---|---|---|---|
| 2,167,274 | A * | 7/1939 | Costigan | 12/142 R |
| 3,175,310 | A * | 3/1965 | MacQuaid | 36/72 R |
| 3,175,311 | A * | 3/1965 | MacQuaid | 36/72 R |
| 4,308,672 | A | 1/1982 | Antonius | |
| 4,309,832 | A | 1/1982 | Hunt | |
| 4,333,248 | A | 6/1982 | Samuels | |
| 4,562,652 | A * | 1/1986 | Hensler | 36/102 |
| 5,012,597 | A | 5/1991 | Thomasson | |
| 5,184,410 | A | 2/1993 | Hamilton | |
| 5,224,279 | A | 7/1993 | Agnew | |
| 5,272,822 | A | 12/1993 | Diaz | |
| 5,481,814 | A | 1/1996 | Spencer | |
| 5,566,477 | A | 10/1996 | Mathis et al. | |
| 5,625,966 | A * | 5/1997 | Perotto et al. | 36/117.2 |
| 5,784,809 | A | 7/1998 | McDonald | |
| 6,189,239 | B1 | 2/2001 | Gasparovic et al. | |
| D472,041 | S | 3/2003 | Kuerbis | |
| 6,539,647 | B2 * | 4/2003 | Diaz | 36/72 R |
| 6,574,889 | B2 | 6/2003 | Cagner | |
| 6,601,323 | B2 | 8/2003 | Tsujino et al. | |
| 7,421,807 | B2 * | 9/2008 | Condie | 36/101 |
| 2005/0060914 | A1 * | 3/2005 | Fuerst | 36/102 |
| 2005/0241179 | A1 * | 11/2005 | Chen | 36/3 A |

* cited by examiner

*Primary Examiner* — Marie Patterson
(74) *Attorney, Agent, or Firm* — Biotech Beach Law Group PC

(57) ABSTRACT

A shoe is provided including a sole, an upper with a transverse aperture, and a cover piece, wherein the cover piece covers the transverse aperture and is affixed to the shoe at medial and lateral ends of the cover piece, and wherein the transverse aperture compresses without compression of the cover piece when the sole bends along a hinged metatarsophalangeal portion when transitioning from a stance phase to a swing phase.

9 Claims, 20 Drawing Sheets

SHOE WITH TRANSVERSE APERTURE AND COVER

FIELD OF THE INVENTION

The present invention relates generally to shoes, and more specifically to a shoe with a transverse aperture and cover, allowing the shoe to bend easily to follow the movement of a human foot transitioning from a stance phase to a swing phase in a gait cycle.

BACKGROUND OF THE INVENTION

Gait is the manner in which humans walk, step, or run. A gait cycle is divided into two phases: stance and swing. The stance phase is the interval in which the foot is on the ground. The swing phase is the interval in which the foot is not in contact with the ground. In the last part of the stance phase, when the foot is transitioning to the swing phase, the heel of the foot lifts off the ground and the foot bends at the metatarsophalangeal joints as the body moves forward. This motion is also known as dorsiflexion of the foot at the metatarsophalangeal joints.

The bending of the foot during the transition from a stance phase to a swing phase is an important consideration in shoe comfort and design. During this bending motion, a shoe upper bunches or protrudes in the metatarsophalangeal region, which may cause discomfort and lead to blistering. Further, bending causes creases in a shoe thereby adversely affecting its appearance and strength in some instances.

Many present day shoes include a sole which bends to follow the movement of the human foot. Several shoes of particular interest are described in the patent literature. U.S. Pat. No. 4,309,832 to Hunt sets forth a shoe with a resilient shoe which incorporates one or two transverse hinge joints, wherein the principle joint passes under the first metatarsophalangeal joint of the foot. U.S. Pat. No. 5,012,597 to Thomasson sets forth a shoe sole with a twist flex portion positioned generally below the ball region of the user's foot. U.S. Pat. No. 5,224,279 to Agnew sets forth a shoe midsole with a transverse concavity along the metatarsal line to provide flexibility. U.S. Pat. No. 5,784,809 to McDonald sets forth a snowboarding boot with an upper which engages a two-piece sole for increased flexibility. U.S. Pat. No. 6,189,239 to Gasparovic et al. sets forth a shoe sole with a flexible member that facilitates abduction bending. The shoe includes a split upper having a forefoot upper portion and a rear upper portion which is held closed while the shoe is worn by the user by a closure mechanism. U.S. Pat. No. 6,574,889 to Cagner sets forth a shoe with a flexible outersole. None of these shoes provides a transverse aperture in the upper which expands and compresses when the sole bends along a medial-lateral axis in the sole's metatarsophalangeal portion. Further, none of these shoes provides a cover piece which covers a transverse aperture and is affixed to the shoe at medial and lateral ends of the cover piece.

There also are shoes described in the patent literature with upper portions that separate when the sole bends. U.S. Pat. No. 5,184,410 to Hamilton sets forth a shoe sole with a pivot hinge which permits pivoting separation of the forward portion of the shoe relative to the rear portion of the shoe. U.S. Pat. No. 5,481,814 to Spencer sets forth a shoe upper divided into front and back parts which are hinged together at the shoe sole. These shoes do not have a transverse aperture in the metatarsophalangeal portion of the upper which compresses when the sole bends to follow a foot transitioning from a stance phase to a swing phase. Rather, the upper of both shoes separates in the rear portion of the shoe at the ankle aperture. Also, the upper only separates to facilitate donning and doffing the shoe. The two portions of the upper remain fastened together while the shoe is in use.

Additionally, several shoe upper covers are described in the patent literature. U.S. Pat. No. 4,308,672 to Antonius sets forth a shoe with a flexible closure assembly to secure the shoe to the wearer's foot. U.S. Pat. No. 4,333,248 to Samuels and U.S. Pat. No. 5,272,822 to Diaz set forth shoes with an at least partially removable protective cover to prevent injuries to the foot. U.S. Pat. No. 5,566,477 to Mathis et al. sets forth a shoelace cover incorporating an interchangeable fashion panel for covering the shoelaces of a gym shoe. U.S. Pat. No. 6,601,323 to Tsujino et al. sets forth a shoelace cover for covering shoelaces to prevent loosening or untying of a tied shoelace bow. The upper covers of these shoes serve various purposes, such as securing the shoe to the wearer's foot, protecting the foot from injuries, and preventing shoelaces from loosening or untying. However, none of these shoe upper covers serves the purpose of covering a transverse aperture in the metatarsophalangeal region.

As such, it may be appreciated that there continues to be a need for a new and improved shoe which completely covers a human foot and bends easily to follow the movement of the foot transitioning from a stance phase to a swing phase in a gait cycle, without bunching or protuberance of the upper in the metatarsophalangeal region.

SUMMARY OF THE INVENTION

A first aspect of the present invention addresses the deficiencies inherent in current shoes by providing a shoe with an upper which includes a transverse aperture and cover. More specifically, the first aspect of the present invention provides a shoe including a sole, an upper with a transverse aperture, and a cover piece. The sole includes a toe portion, a heel portion, and a hinged metatarsophalangeal portion. The upper includes a toe portion, a rear portion, and a transverse aperture extending along a metatarsophalangeal portion. The cover piece covers the transverse aperture and is affixed to the shoe at medial and lateral ends of the cover piece. The transverse aperture compresses without compression of the cover piece when the sole bends along the hinged metatarsophalangeal portion when transitioning from a stance phase to a swing phase. The hinged metatarsophalangeal portion of the sole may include an indented crease line, cylinder hinge joint, flexible material, or any other hinge means.

The first aspect of the present invention provides several embodiments. In one embodiment, the cover piece is affixed to the toe portion of the upper. In another embodiment, the cover piece is affixed to the tongue. In another embodiment, the upper includes a laced tongue. In another embodiment, the upper includes a solid tongue.

A second aspect of the present invention provides a shoe including a sole and an upper. The sole includes a heel portion, a toe portion, and a hinged metatarsophalangeal portion. The upper includes a rear portion transversely separated from a toe portion at a metatarsophalangeal region. The upper rear portion is partially covered by the upper toe portion during a stance phase. The upper toe portion slides over the upper rear portion when the sole bends along the hinged metatarsophalangeal portion when transitioning from a stance phase to a swing phase.

BRIEF DESCRIPTION OF THE DRAWINGS

Those of skill in the art will understand that the drawings, described below, are for illustrative purposes only. The drawings are not intended to limit the scope of the present teachings in any way.

DETAILED DESCRIPTION OF THE INVENTION

Figure 1:
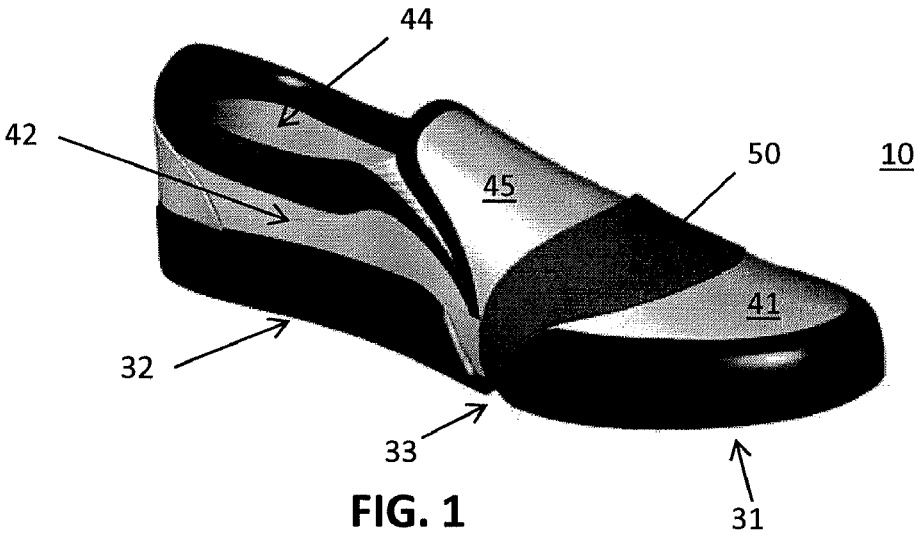
FIG. 1 is a left perspective view of one embodiment of the first aspect of the present invention showing shoe 10 in an unbent conformation.
Figure 2:
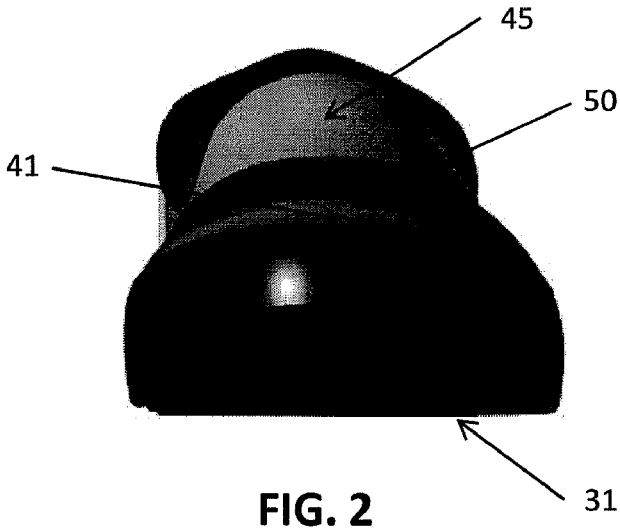
FIG. 2 is a front elevational view thereof.
Figure 3:
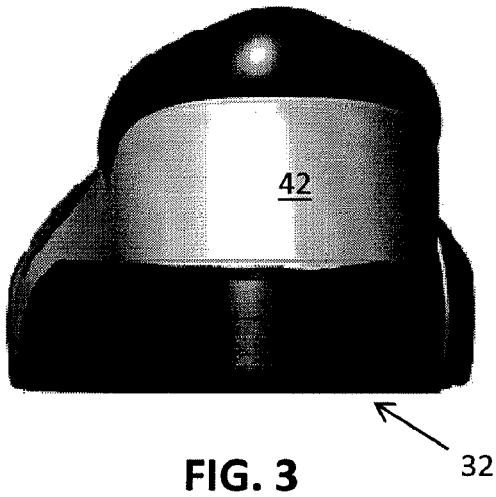
FIG. 3 is a rear elevational view thereof.
Figure 4:
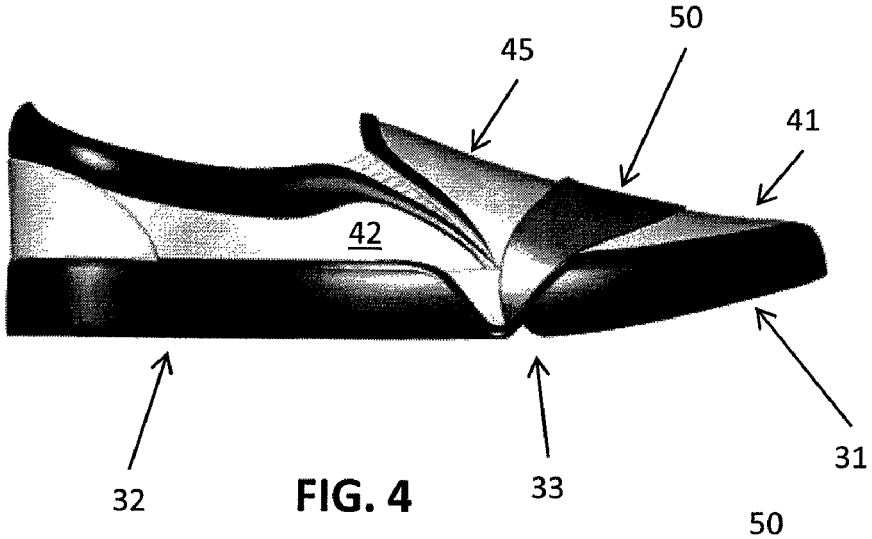
FIG. 4 is a left elevational view of thereof.
Figure 5:
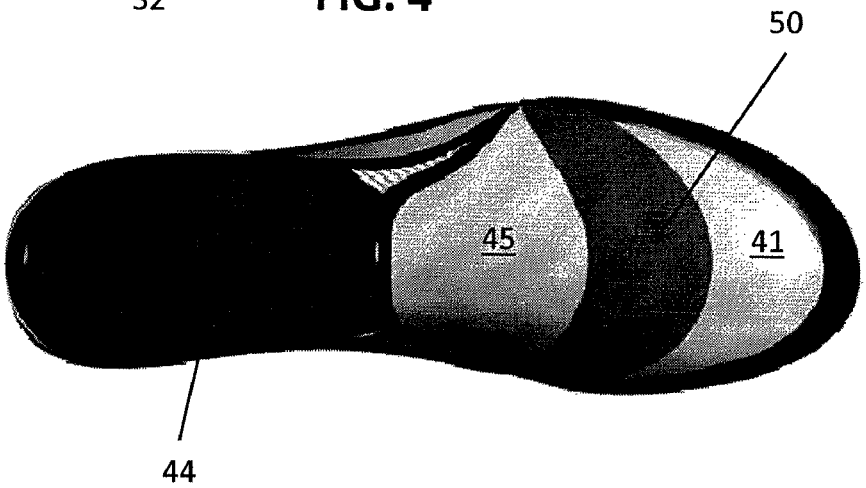
FIG. 5 is a top plan view thereof.
Figure 6:
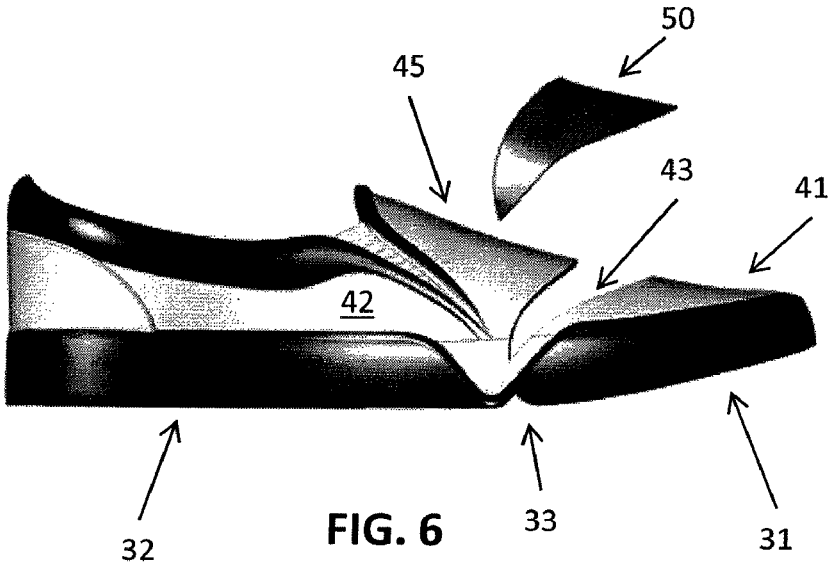
FIG. 6 is a left elevational view thereof showing cover piece 50 removed exposing transverse aperture 43.
Figure 7:
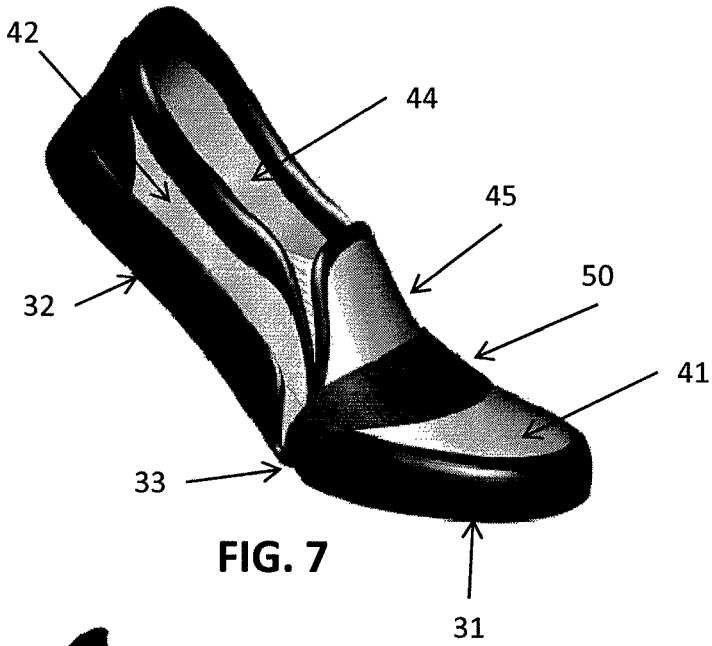
FIG. 7 is a left perspective view of one embodiment of the present invention showing shoe 10 in a bent conformation.
Figure 8:
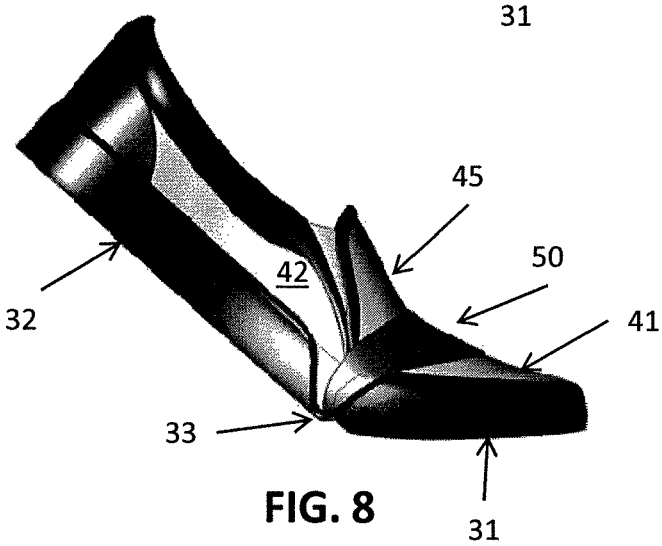
FIG. 8 is a left elevational view thereof.
Figure 9:
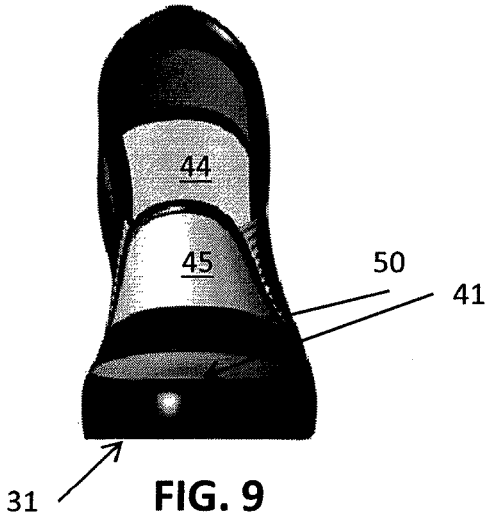
FIG. 9 is a front elevational view thereof.
Figure 10:
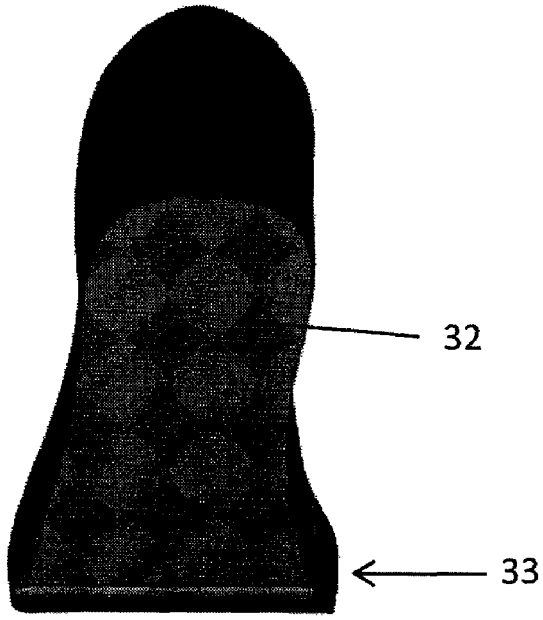
FIG. 10 is a rear elevational view thereof.

Although the terms used herein are known by those skilled in the art to which the present invention belongs, the following definitions may prove useful to the less skilled artisan.

The term "transitioning from a stance phase to a swing phase" as used herein refers to the bending motion of a shoe or sole as the shoe or sole would bend in use when a human foot undergoes dorsiflexion at the metatarsophalangeal joints. During this motion, the heel of the foot lifts off the ground and the foot bends at the metatarsophalangeal joints as the body moves forward. Similar to the motion of a foot, the shoe bends along a medial-lateral axis in the metatarsophalangeal portion of the sole while the toe portion of the sole remains on the ground and the heel portion of the sole lifts off the ground.

The term "unbent conformation" as used herein refers to the conformation of a shoe when the sole of the shoe is not flexed in the metatarsophalangeal portion. A shoe in use is in an unbent conformation when a wearer is in the middle part of a stance phase in a gait cycle. During the middle part of a stance phase, both the toe and heel parts of a human foot are on the ground. Similarly, the toe and heel portions of a shoe in use are on the ground and the sole is not flexed during this part of a stance phase.

The term "bent conformation" as used herein refers to the conformation of a shoe when the sole of the shoe is flexed at the metatarsophalangeal portion to follow the motion of a human foot transitioning from a stance phase to a swing phase in a gait cycle.

The term "sole" as used herein refers to the bottom portion of a shoe. A sole may include an insole, a midsole, and an outsole.

The term "sole toe portion" as used herein refers to the portion of a sole that extends from the metatarsophalangeal portion of the sole to the distal end of the shoe.

The term "sole heel portion" as used herein refers to the portion of a sole that extends from the metatarsophalangeal portion of the sole to the proximal end of the shoe.

The terms "sole metatarsophalangeal portion" and "hinged metatarsophalangeal portion" as used herein refer to the portion of a sole that is between the sole toe portion and the sole heel portion.

The term "upper" as used herein refers to the portion of a shoe above the sole. An upper may include a quarter, vamp, counter, and lining.

The term "upper toe portion" as used herein refers to the portion of an upper that extends from the transverse aperture or tongue of the upper to the proximal end of the shoe.

The term "upper rear portion" as used herein refers to the portion of an upper that extends from the transverse aperture or toe portion of the upper to the distal end of the shoe. The upper rear portion includes the tongue and the ankle aperture.

The terms "transverse aperture" and "transverse aperture extending along a metatarsophalangeal portion" as used herein refer to an aperture that separates the upper toe portion and the tongue.

The term "ankle aperture" as used herein refers to an aperture in the upper rear portion proximal of the tongue. A human foot enters and exits a shoe through the ankle aperture during donning and doffing.

The term "tongue" as used herein refers to the dorsal part of a shoe upper rear portion between the transverse aperture or toe portion of the upper and the ankle aperture. A tongue may be solid or include lacing or other means for fastening the shoe around a human foot.

The term "cover piece" as used herein refers to a piece of material affixed to a shoe that serves to cover the transverse aperture.

The term "hinge" as used herein refers to a joint device or flexible piece that allows the pivoting or bending of a shoe sole. As used herein with respect to a sole metatarsophalangeal portion, the term refers to the sole metatarsophalangeal portion having increased bending or flexibility compared to the sole toe or heel portions.

The term "foxing" as used herein refers to a material that partially covers the upper portion of a shoe and surrounds the shoe at the intersection between the upper and sole. The bending or flexibility of the sole metatarsophalangeal portion may be increased compared to the sole toe or heel portions by decreasing the amount or thickness of the foxing in the metatarsophalangeal region of the shoe compared to the amount or thickness of the foxing in the toe or heel portions of the shoe.

The term "transverse" as used herein refers to the property of extending across a shoe along a medial-lateral axis. As used herein with respect to the separation of an upper rear portion and an upper toe portion, the term refers to separation of the two portions along a medial-lateral axis.

The term "compress" as used herein refers generally to the act of contracting or becoming reduced in compass. As used herein with respect to a transverse aperture, the term refers to a contraction or reduction in compass of the transverse aperture such that the upper toe portion and the tongue become drawn together. As used herein with respect to a cover piece, the term refers to a contraction or reduction in compass of the material that constitutes the cover piece.

The term "compass" as used herein refers to an area or space within limits. As used herein with reference to a cover piece, the term refers to the area of the material that constitutes the cover piece as defined by its length and width.

The term "metatarsal bone" as used herein refers to one of the row of elongated bones in the human foot between the tarsus and the phalanges.

The term "phalange" as used herein refers to one of the bones of the human toes. A first phalange is one of the bones in the first row of phalanges from the metatarsal bones.

The term "metatarsophalangeal joint" as used herein refers to the joint between a metatarsal bone and a first phalange.

The term "metatarsophalangeal region" as used herein with respect to a human foot refers to the dorsal portion of the foot directly above or plantar portion of the foot directly below the row of metatarsophalangeal joints.

The term "proximal" as used herein refers to the heel or rear end of a human foot or the corresponding part of a shoe.

The term "distal" as used herein refers to the toe end of a human foot or the corresponding part of a shoe.

The term "medial" as used herein refers to the side of a human foot lying closest to the median axis of the body or the corresponding part of a shoe.

The term "lateral" as used herein refers to the side of a human foot lying farthest from the median axis of the body or the corresponding part of a shoe.

The term "dorsal" as used herein refers to the upper surface of a human foot or the corresponding part of a shoe.

The term "plantar" as used herein refers to the lower surface of a human foot or the corresponding part of a shoe.

In contrast to previous shoes, the advances of the present invention permit the shoe which completely covers a human foot to bend easily to follow the movement of the foot transitioning from a stance phase to a swing phase in a gait cycle, without the bunching or protuberance of the upper above the metatarsophalangeal joints of the foot.

Referring generally to FIGS. 1-34 and 48, the first aspect of the present invention depicted as shoe 10 includes a sole, an upper affixed to the sole, and a cover piece 50. The sole includes a toe portion 31, a heel portion 32, and a hinged metatarsophalangeal portion 33. The upper includes a toe portion 41, a rear portion 42, and a transverse aperture 43. Upper rear portion 42 includes a tongue 45 and an ankle aperture 44. Upper rear portion 42 may be extended to form a boot. Cover piece 50 is affixed to the shoe at medial and lateral ends of cover piece 50. The sole bends along a medial-lateral axis in hinged metatarsophalangeal portion 33 when the sole transitions from a stance phase to a swing phase.

Hinged metatarsophalangeal portion 33 extends transversely across the shoe from the shoe's medial end to the shoe's lateral end. When the shoe is in use, hinged metatarsophalangeal portion 33 lies substantially below the metatarsophalangeal region of the foot. Hinged metatarsophalangeal portion 33 may extend as far as two inches distally and proximally from the line formed by the row of metatarsophalangeal joints in the foot.

Figure 20:
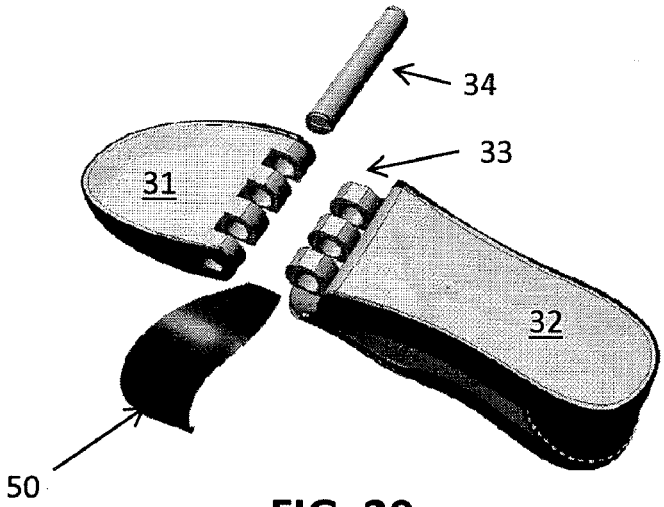
FIG. 20 is a bottom perspective view thereof showing cylinder hinge joint 34 disassembled.
Figure 21:
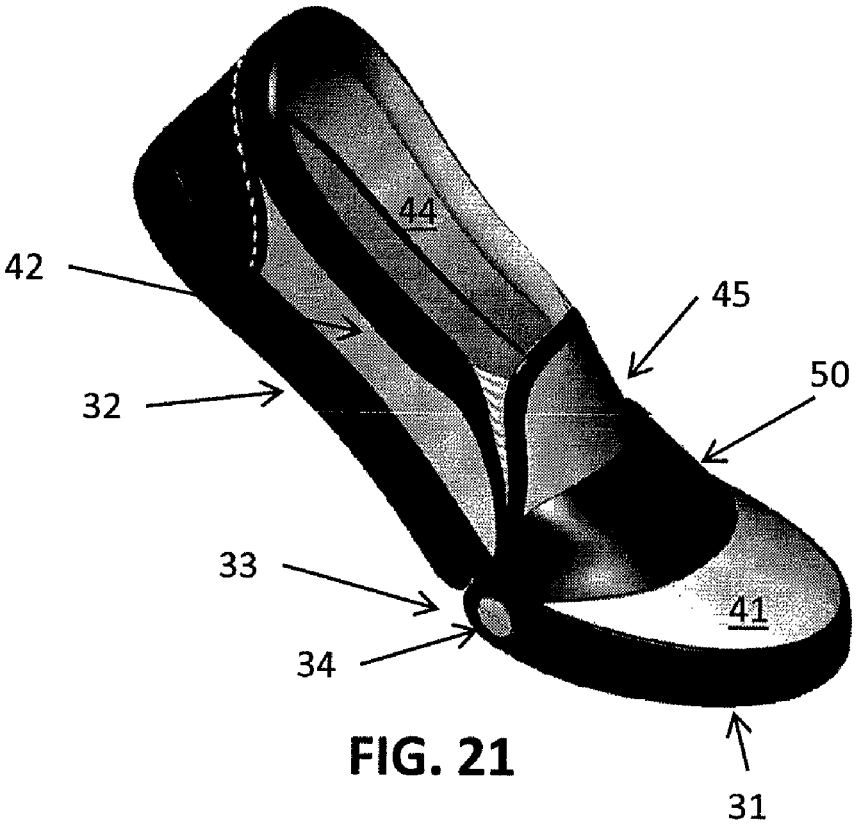
FIG. 21 is a left perspective view of the alternative embodiment of FIG. 12 showing shoe 10 in a bent conformation.

Hinged metatarsophalangeal portion 33 may include an indented crease line, cylinder hinge joint, flexible material, or any other hinge means. In the alternative embodiment of the present invention shown in FIGS. 12-22, hinged metatarsophalangeal portion 33 includes a cylinder hinge joint 34. FIG. 20 shows the sole disassembled for clarity to show the pieces of cylinder hinge joint 34.

Figure 11:
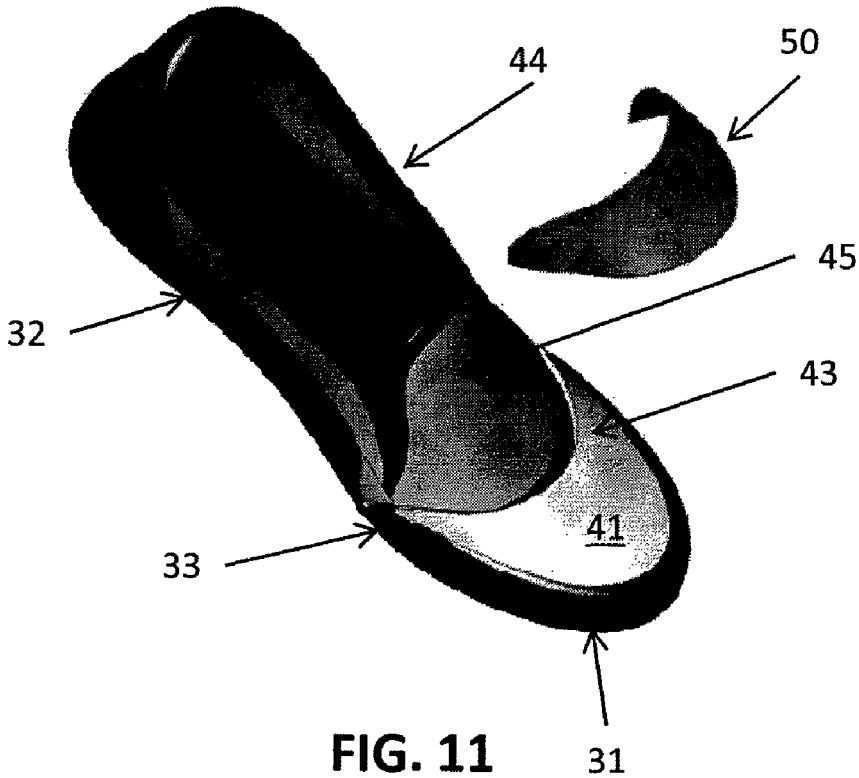
FIG. 11 is a top perspective view thereof showing cover piece 50 removed exposing compressed transverse aperture 43.
Figure 12:
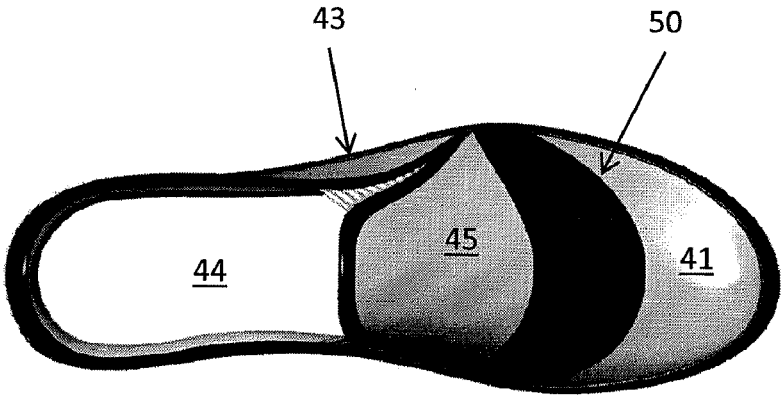
FIG. 12 is a top plan view of an alternative embodiment of the first aspect of the present invention showing shoe 10 in an unbent conformation.
Figure 13:
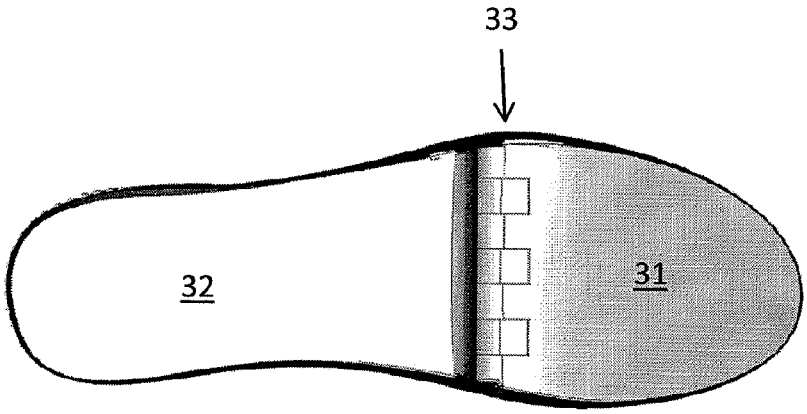
FIG. 13 is a bottom plan view thereof.
Figure 14:
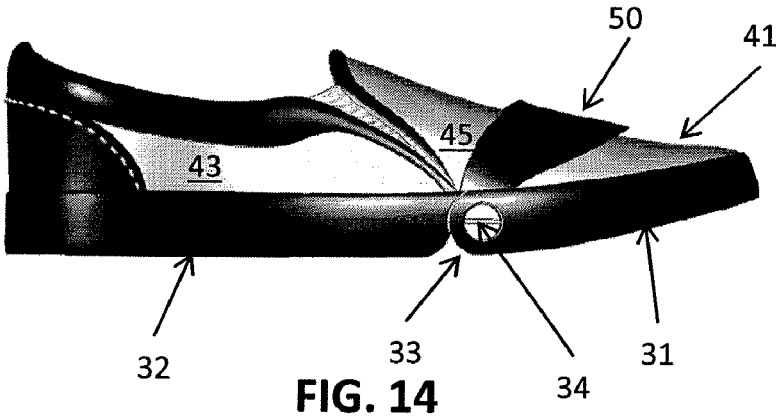
FIG. 14 is a left elevational view thereof.
Figure 15:
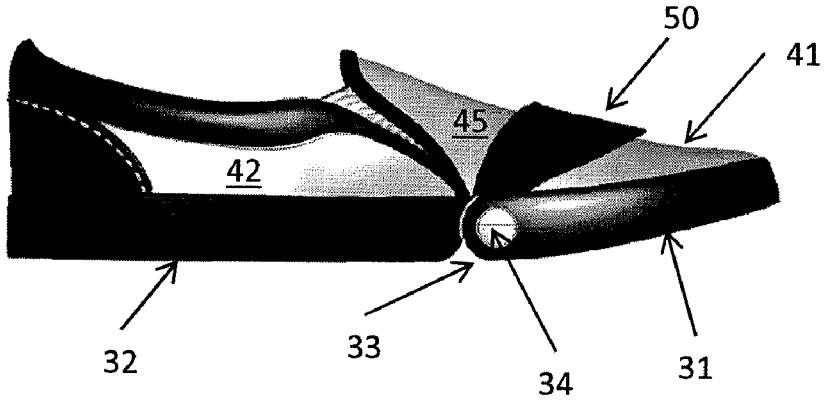
FIG. 15 is a right elevational view thereof.
Figure 16:
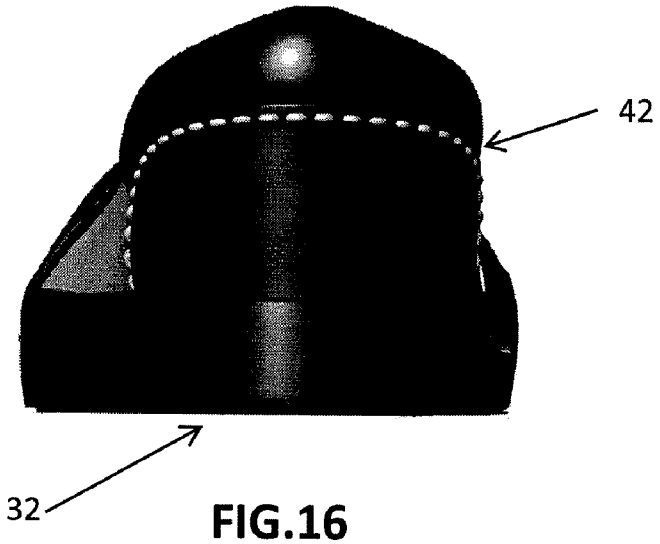
FIG. 16 is a rear elevational view thereof.
Figure 17:
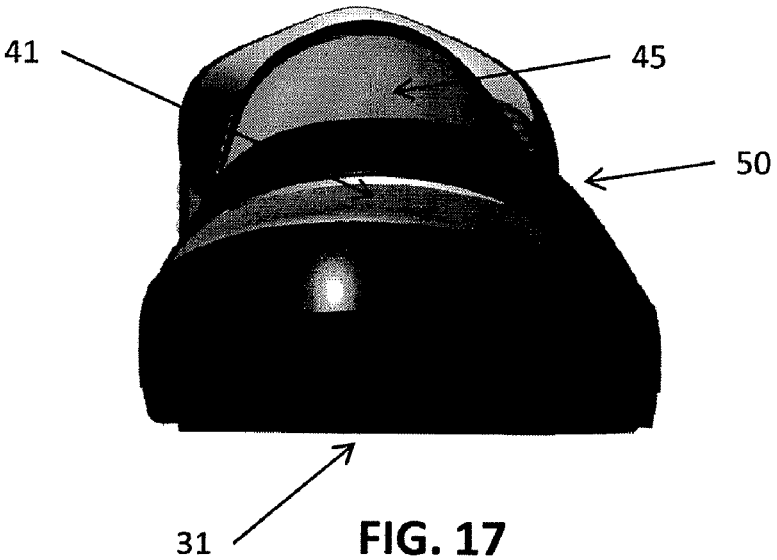
FIG. 17 is a front elevational view thereof.
Figure 18:
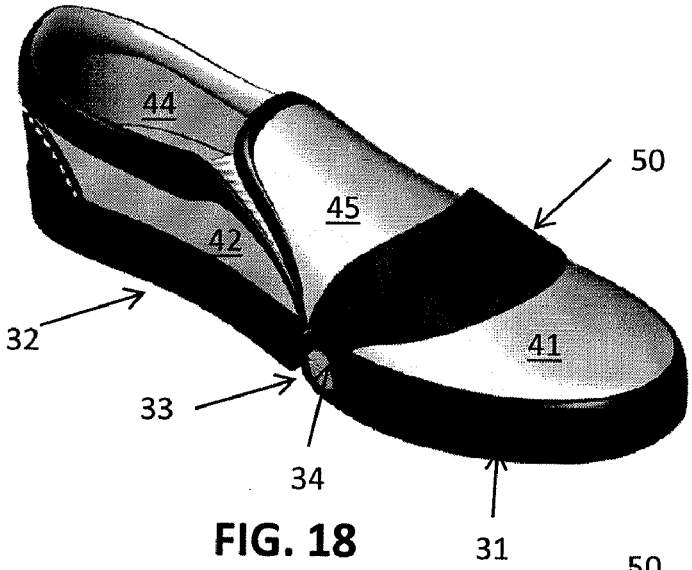
FIG. 18 is a left perspective view thereof.
Figure 19:
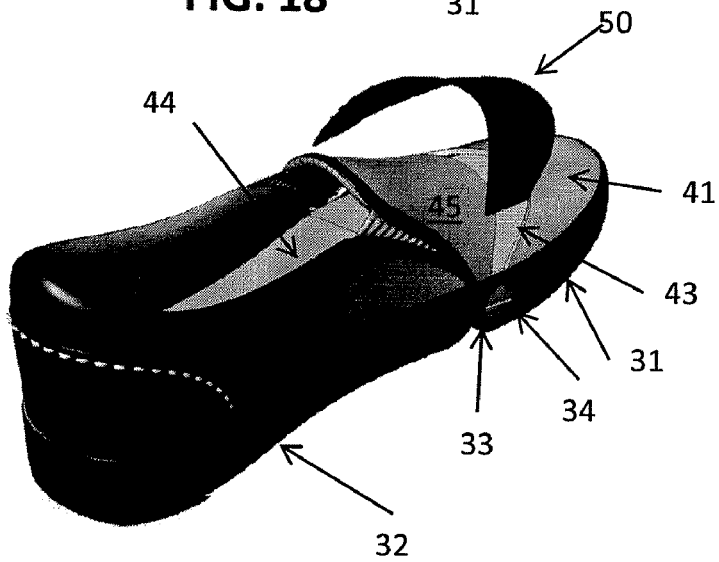
FIG. 19 is a top perspective view thereof showing cover piece 50 removed exposing transverse aperture 43.
Figure 22:
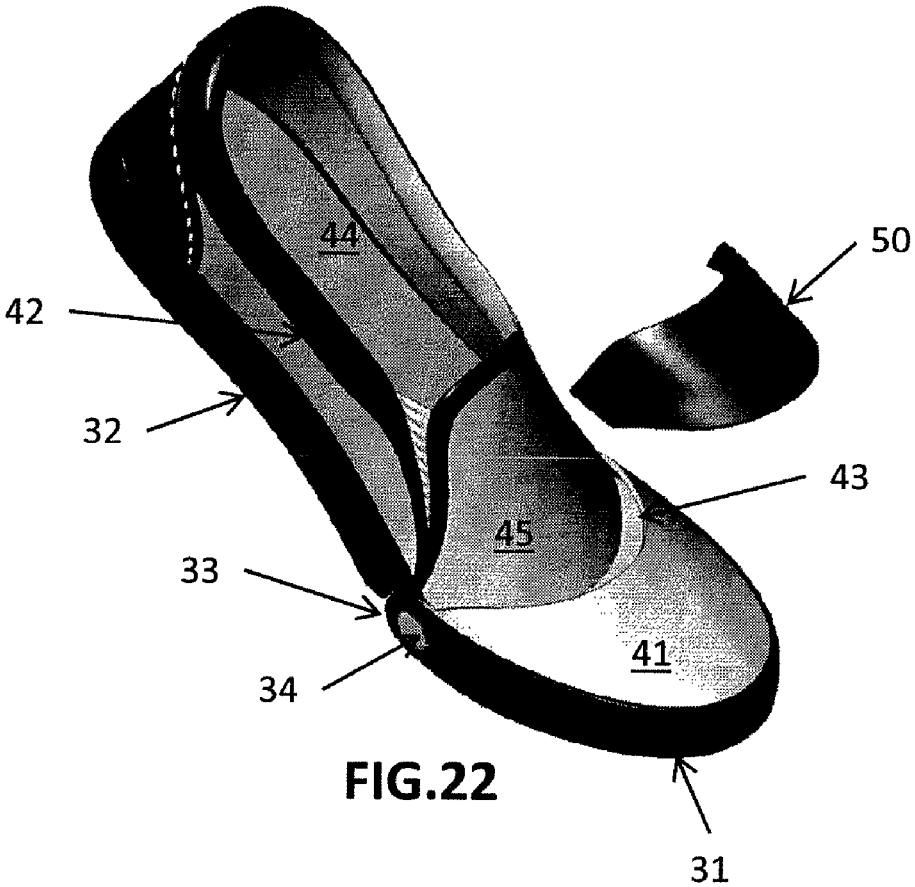
FIG. 22 is a left perspective view thereof showing cover piece 50 removed exposing compressed transverse aperture 43.
Figure 23:
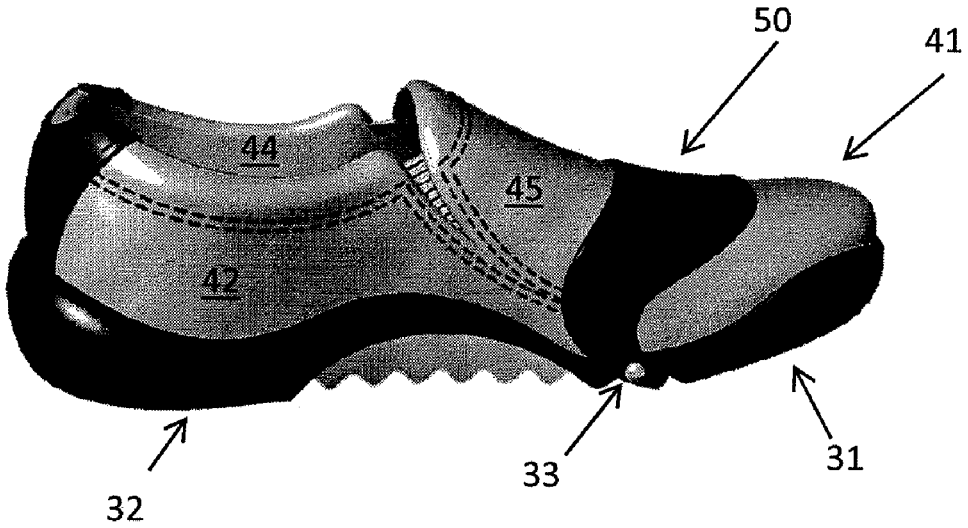
FIG. 23 is a top perspective view of an alternative embodiment of the first aspect of the present invention showing shoe 10 in an unbent conformation.
Figure 24:
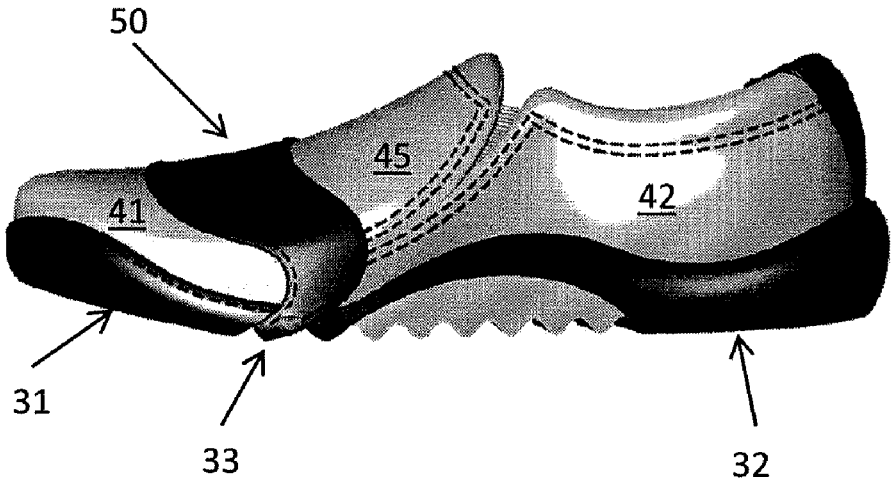
FIG. 24 is a right elevational view thereof.
Figure 25:
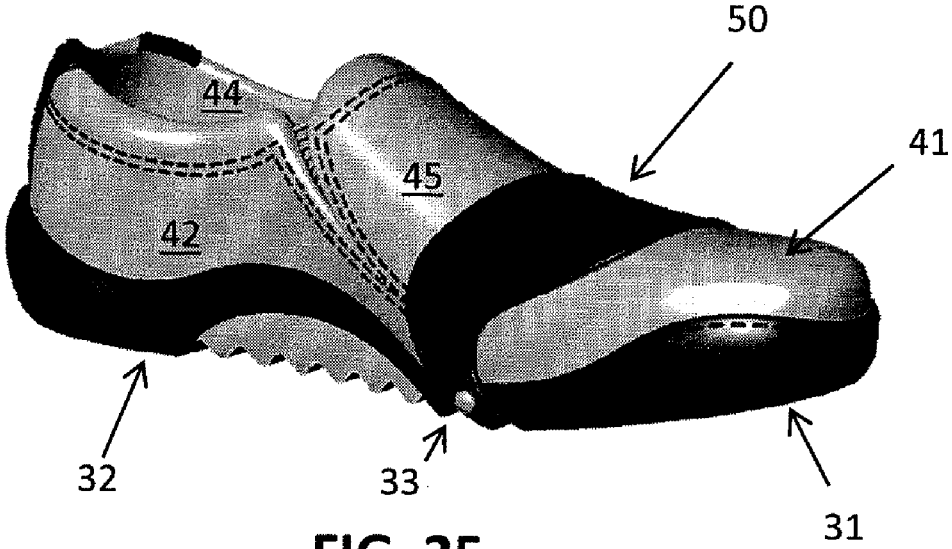
FIG. 25 is a left perspective view thereof.
Figure 26:
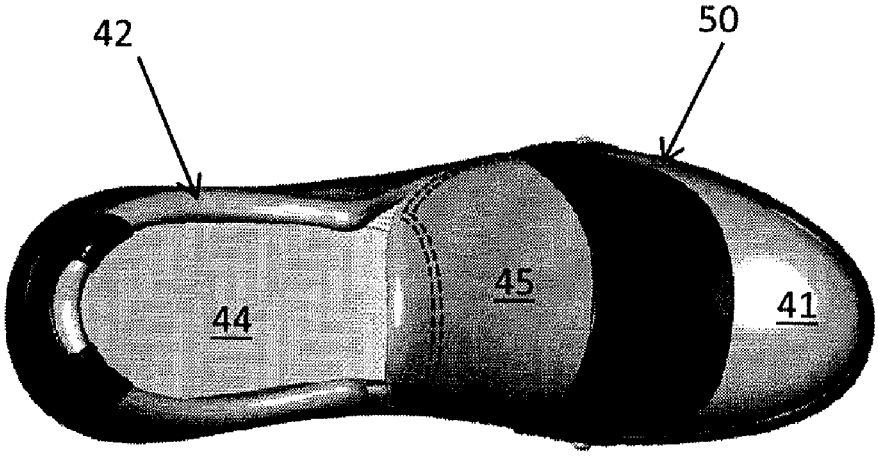
FIG. 26 is a top plan view thereof.
Figure 27:
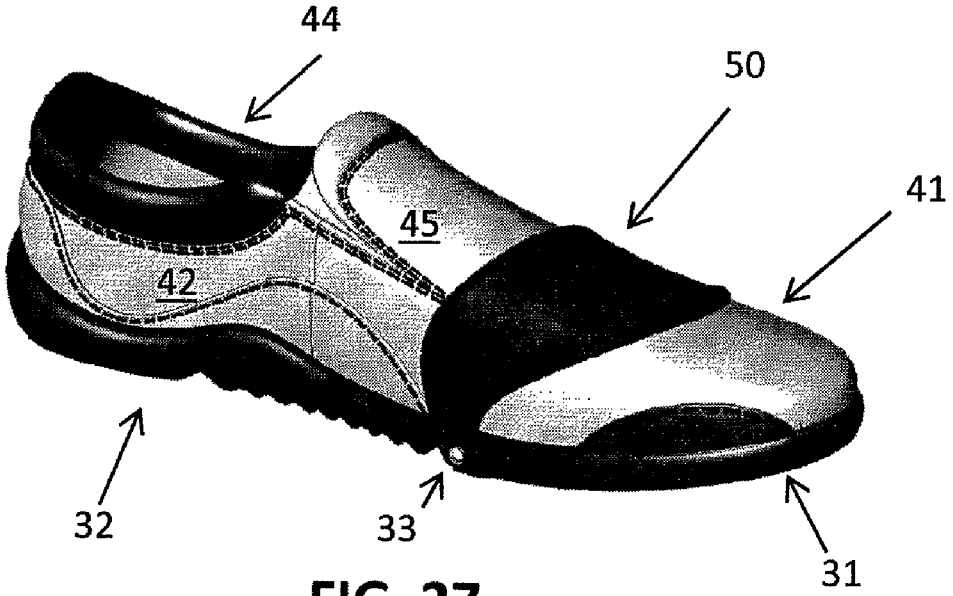
FIG. 27 is a left perspective view of an alternative embodiment of the first aspect of the present invention showing shoe 10 in an unbent conformation.
Figure 28:
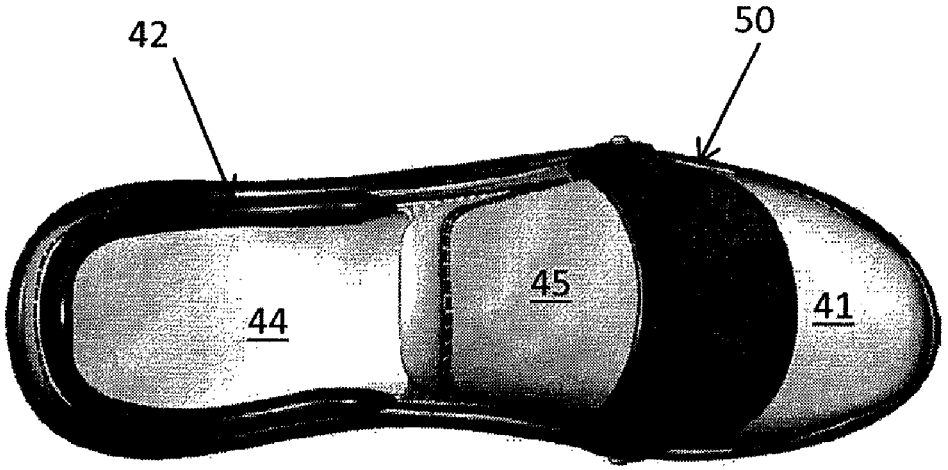
FIG. 28 is a top plan view thereof.
Figure 29:
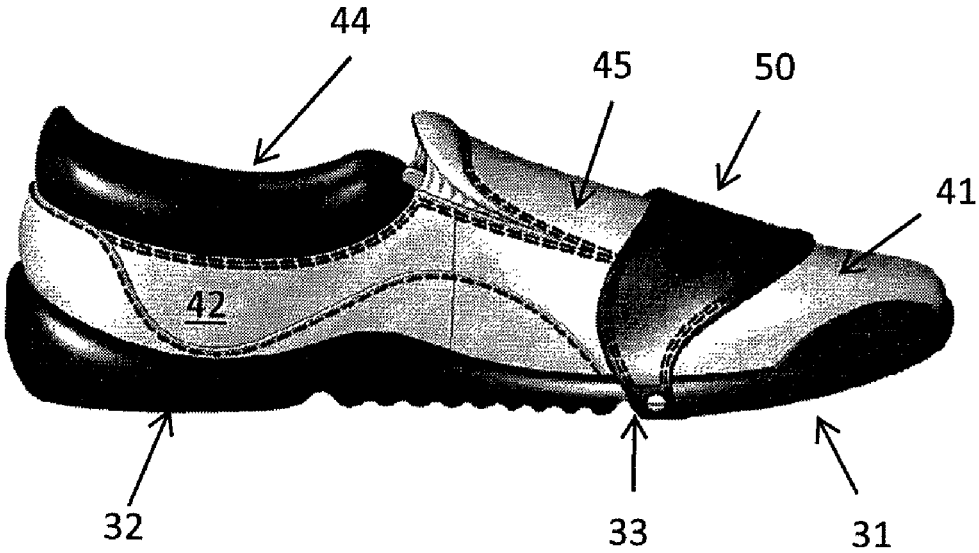
FIG. 29 is a left elevational view thereof.
Figure 30:
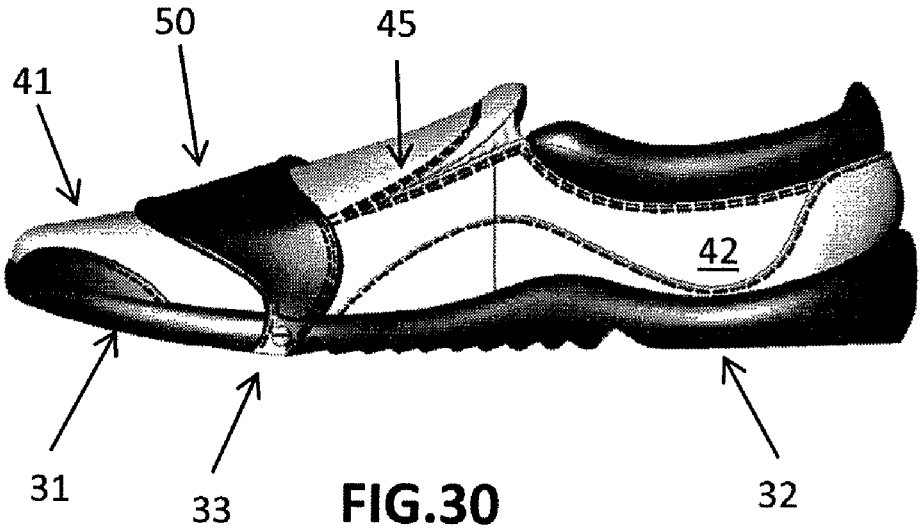
FIG. 30 is a right elevational view thereof.
Figure 31:
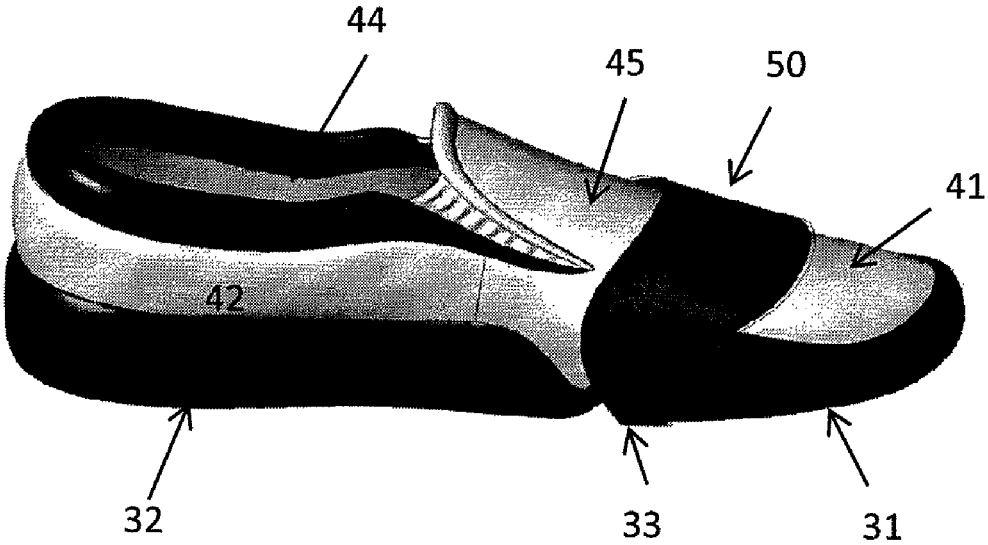
FIG. 31 is a left perspective view of an alternative embodiment of the first aspect of the present invention showing shoe 10 is an unbent conformation.
Figure 32:
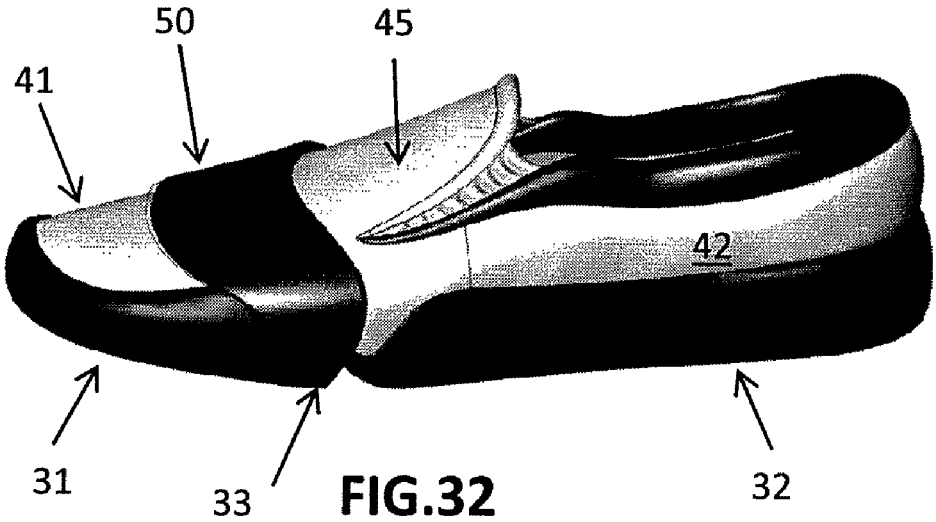
FIG. 32 is a right perspective view thereof.
Figure 33:
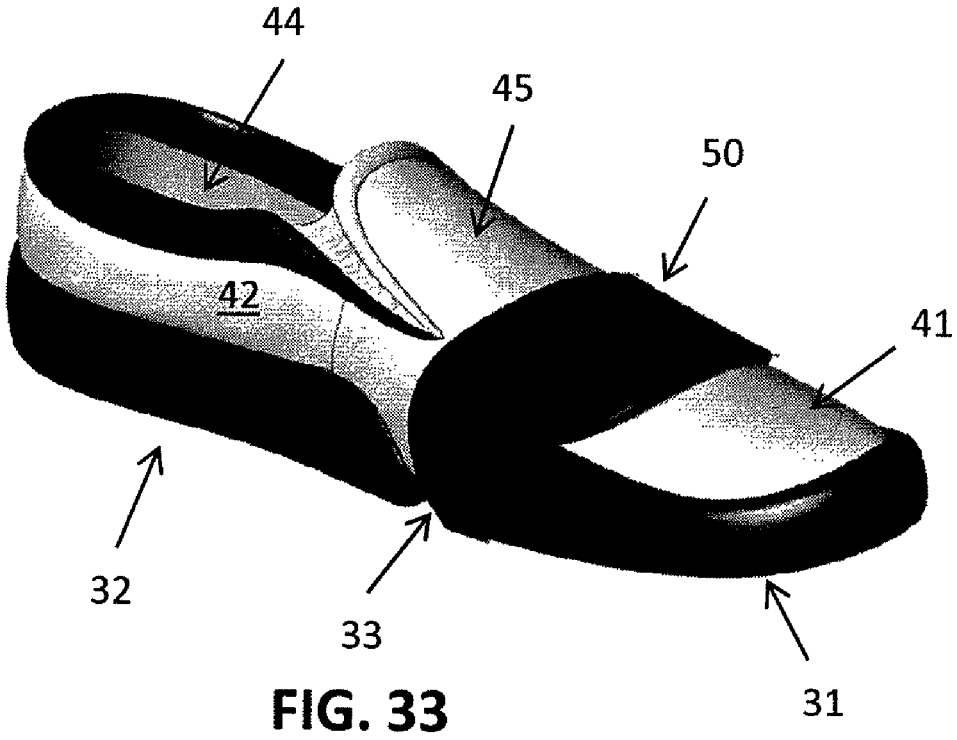
FIG. 33 is a top perspective view thereof.
Figure 34:
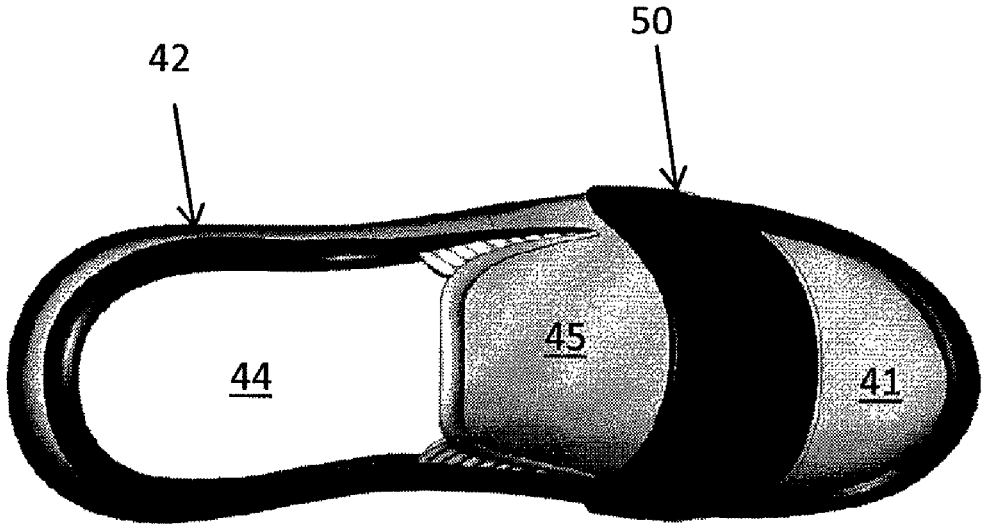
FIG. 34 is a top plan view thereof.
Figure 35:
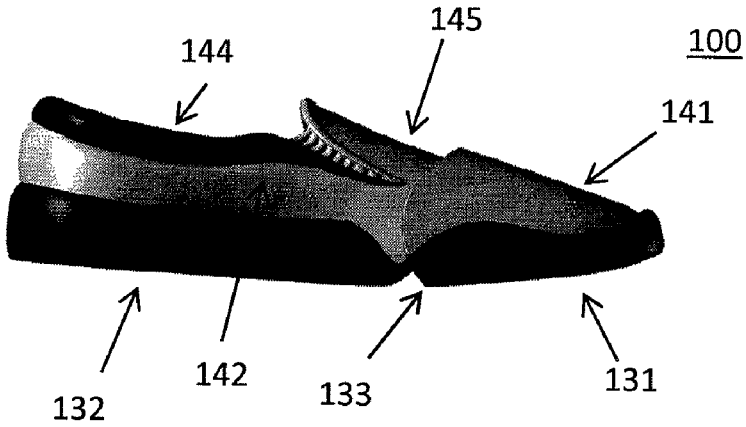
FIG. 35 is a left elevational view of one embodiment of the second aspect of the present invention showing shoe 10 is an unbent conformation.
Figure 36:
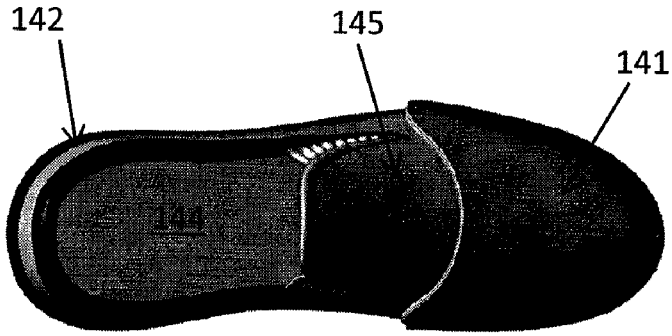
FIG. 36 is a top plan view thereof.
Figure 37:
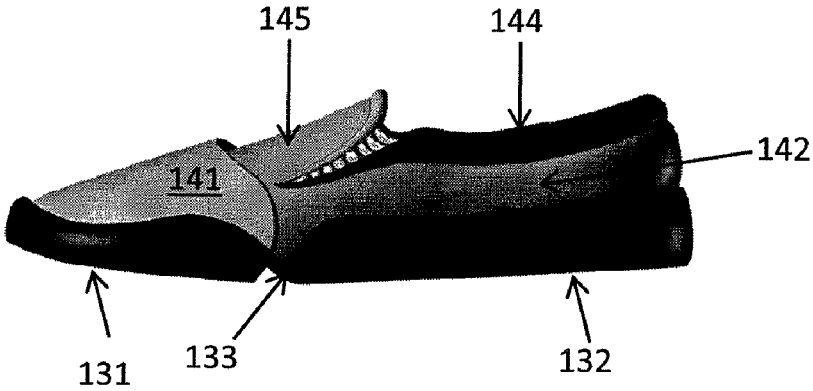
FIG. 37 is a right elevational view thereof.
Figure 38:
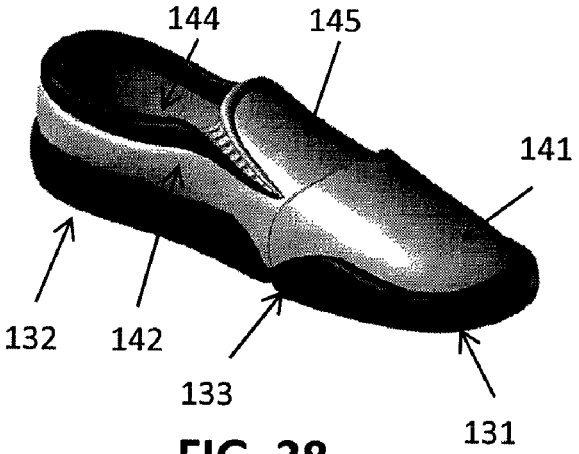
FIG. 38 is a left perspective view thereof.
Figure 39:
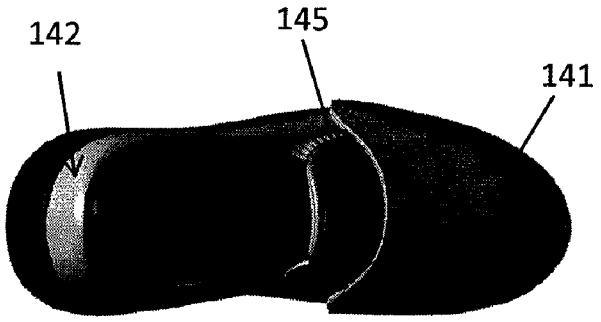
FIG. 39 is a top plan view of the embodiment of FIG. 35 showing shoe 10 in a bent conformation.
Figure 40:
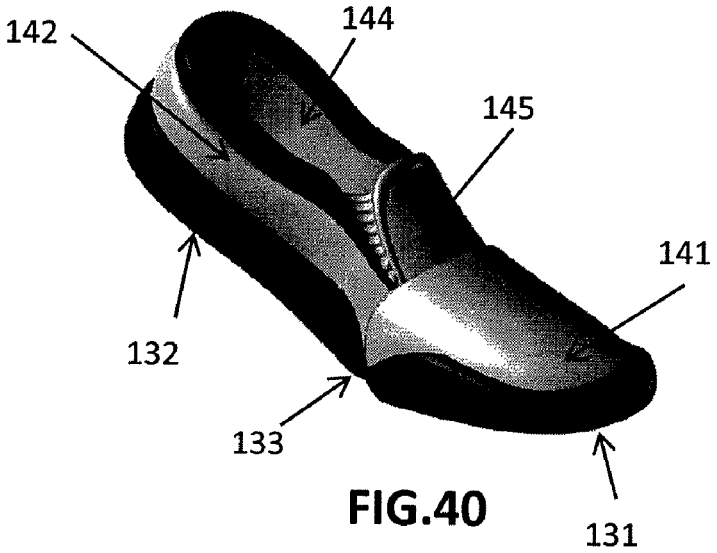
FIG. 40 is a left perspective view thereof.
Figure 41:
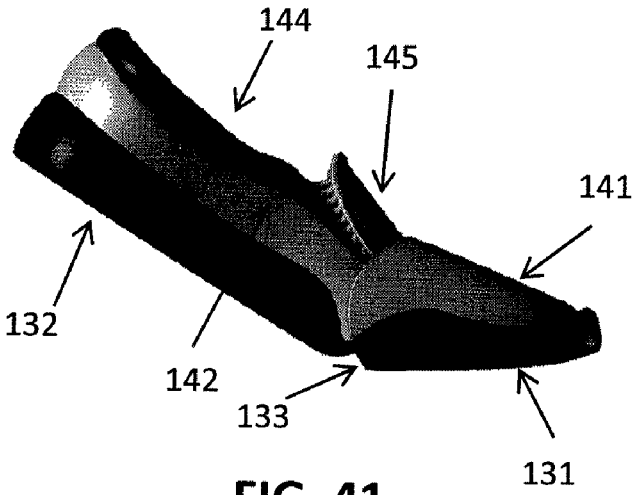
FIG. 41 is a left elevational view thereof.
Figure 42:
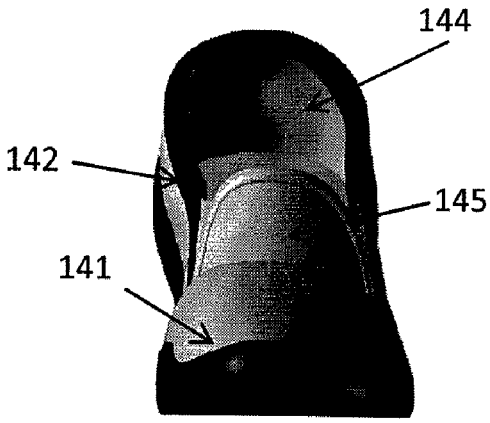
FIG. 42 is a front elevation view thereof.
Figure 43:
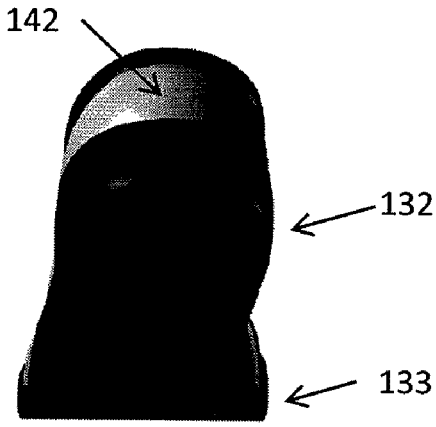
FIG. 43 is a rear elevational view thereof.
Figure 44:
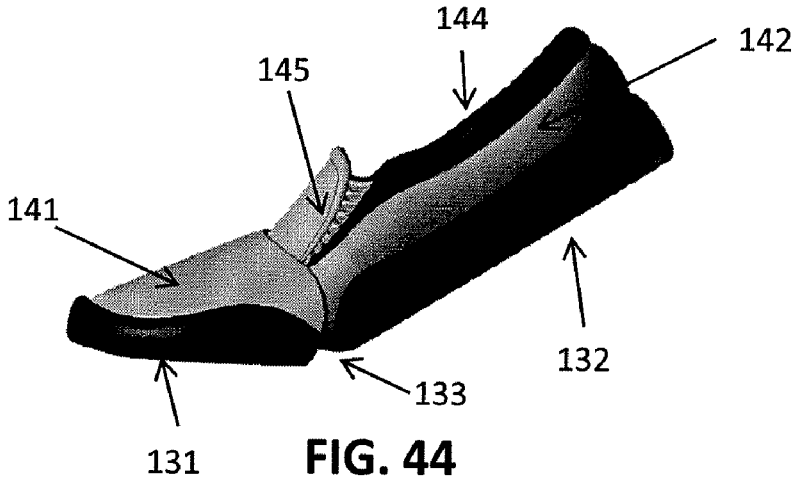
FIG. 44 is a right elevational view thereof.
Figure 45:
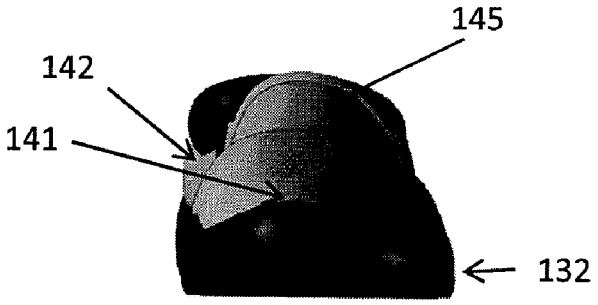
FIG. 45 is a front elevational view of the embodiment of FIG. 35 showing shoe 10 in an unbent conformation.
Figure 46:
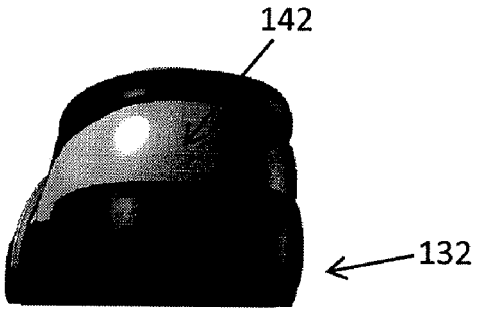
FIG. 46 is a rear elevational view thereof.
Figure 47:
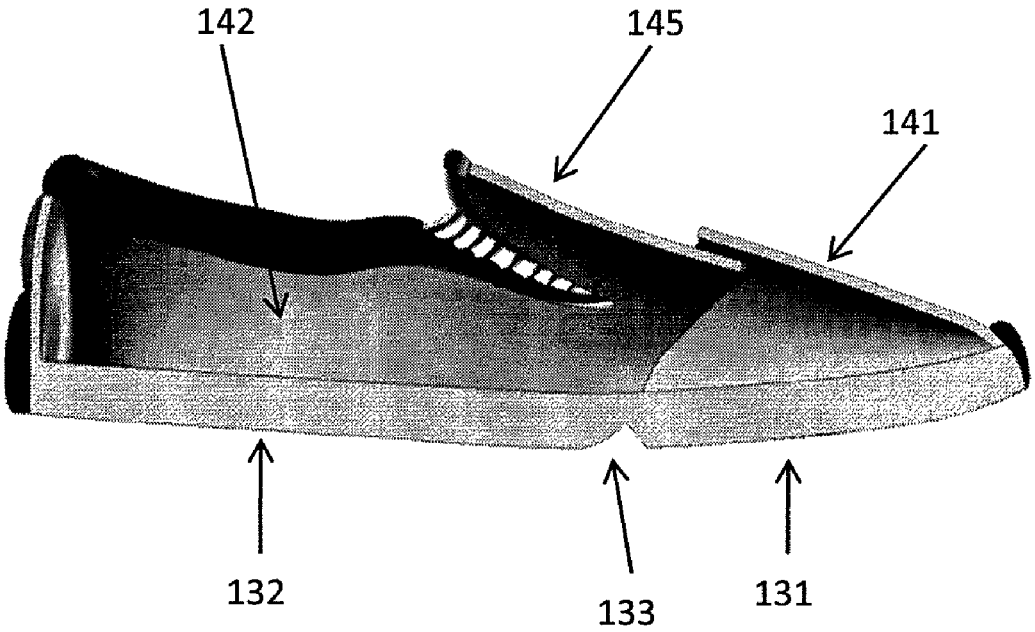
FIG. 47 is a left elevational cross-section thereof.
Figure 48A:
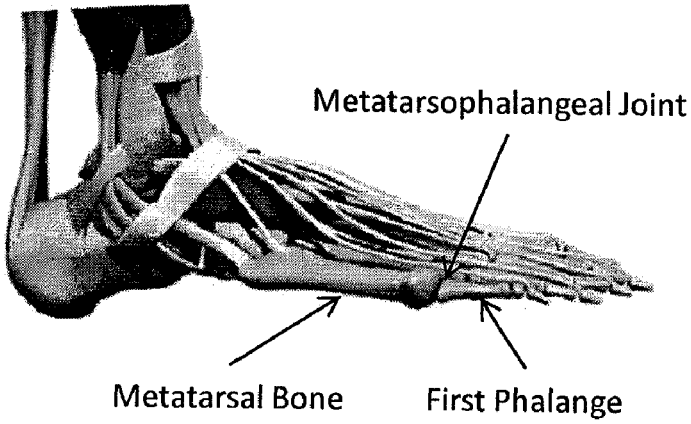
FIG. 48*a* shows an anatomical depiction of a human foot.
Figure 48B:
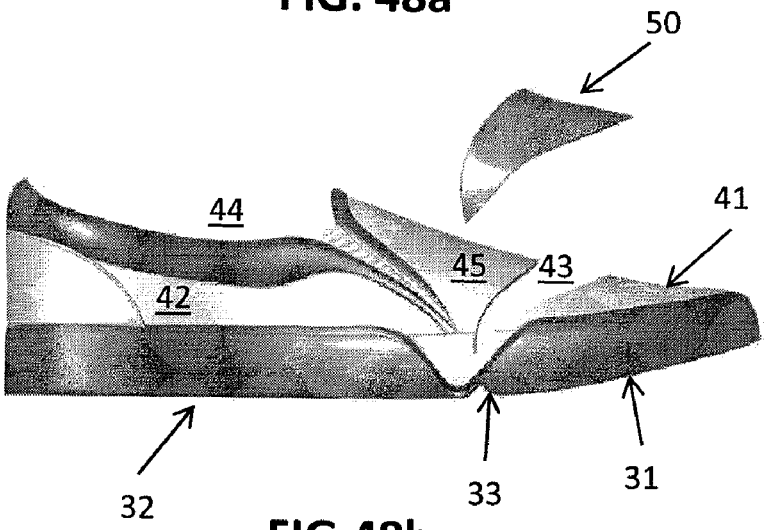
FIG. 48*b* is a left elevational view of one embodiment of first aspect of the present invention showing cover piece 50 removed exposing transverse aperture 43.
Figure 48C:
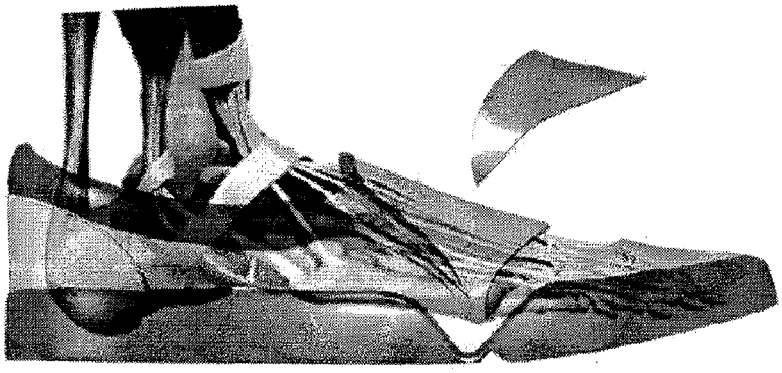
FIG. 48*c* is a juxtaposition of FIG. 48*b* on FIG. 48*a* which shows how a human foot would be positioned inside the present invention.

Transverse aperture 43 extends from the shoe's lateral side to the shoe's medial side. Transverse aperture 43 lies between upper toe portion 41 and tongue 45 and does not abut ankle aperture 44. As the sole bends while transitioning from a stance phase to a swing phase, transverse aperture 43 compresses such that upper toe portion 41 and tongue 45 become drawn together. Referring to FIGS. 6, 11, 19, 20, 22, and 48, cover piece 50 is removed for clarity to show transverse aperture 43 in both an unbent conformation (FIGS. 6, 19, 20, and 47) and a bent conformation (FIGS. 11 and 22).

Preferably, as the sole bends along hinged metatarsophalangeal portion 33 when transitioning from a stance phase to a swing phase, cover piece 50 may bend or flex but does not compress. Rather, the compass of cover piece 50 remains fixed while transverse aperture 43 compresses. In some embodiments, cover piece 50 is composed of canvas, leather, or polymer (rubber or plastic). In some embodiments, cover piece 50 is rigid, which prevents bending.

In one embodiment of the present invention, cover piece 50 is affixed to upper toe portion 41 but not to tongue 45. As the sole bends along hinged metatarsophalangeal portion 33 when transitioning from a stance phase to a swing phase, cover piece 50 and upper toe portion 41 remain fixed relative to each other while a portion of tongue 45 slides under cover piece 50.

In another embodiment, cover piece 50 is affixed to tongue 45 but not to upper toe portion 41. As the sole bends along hinged metatarsophalangeal portion 33 when transitioning from a stance phase to a swing phase, cover piece 50 and tongue 45 remain fixed relative to each other while cover piece 50 slides over a portion of upper toe portion 41

Referring generally to FIGS. 35-47, the second aspect of the present invention depicted as shoe 100 includes a sole and an upper affixed to the sole. The sole includes a toe portion 131, a heel portion 132, and a hinged metatarsophalangeal portion 133. The upper includes a toe portion 141 and a rear portion 142. Upper rear portion 142 includes a tongue 145 and an ankle aperture 144. Upper rear portion 142 may be extended to form a boot. Upper rear portion 142 is transversely separated from upper toe portion 141. The sole bends along a medial-lateral axis in hinged metatarsophalangeal portion 133 when the sole transitions from a stance phase to a swing phase.

Hinged metatarsophalangeal portion 133 extends transversely across the shoe from the shoe's medial end to the shoe's lateral end. When the shoe is in use, hinged metatarsophalangeal portion 133 lies substantially below the metatarsophalangeal region of the foot. Hinged metatarsophalangeal portion 133 may extend as far as two inches distally and proximally from the line formed by the row of metatarsophalangeal joints in the foot.

Hinged metatarsophalangeal portion 133 may include an indented crease line, cylinder hinge joint, flexible material, or any other hinge means.

Upper rear portion 142 is transversely separated from upper toe portion 141 either partially or completely. In embodiments in which upper rear portion 142 is only partially transversely separated from upper toe portion 141, the two portions are at least 50% separated. Toe portion 141 extends over and partially covers upper rear portion 142 in a stance phase. As the sole bends while transitioning from a stance phase to a swing phase, toe portion 141 slides over upper rear portion 142.

Having described the invention in detail, it will be apparent that modifications, variations, and equivalent embodiments are possible without departing the scope of the invention defined in the appended claims.

What is claimed is:

1. A shoe comprising:

(a) a sole comprising a toe portion, a heel portion, and a hinged metatarsophalangeal portion;

(b) an upper comprising a toe portion, a rear portion, a tongue, and a transverse aperture extending along a metatarsophalangeal portion; and (c) a cover piece affixed to the tongue;

wherein the cover piece covers the transverse aperture and is affixed to the shoe at medial and lateral ends of the cover piece;

wherein the transverse aperture compresses without compression of the cover piece when the sole bends along the hinged metatarsophalangeal portion when transitioning from a stance phase to a swing phase.

2. The shoe of claim 1 wherein the hinged metatarsophalangeal portion comprises a hinge extending transversely across the sole selected from the group consisting of an indented crease line, a flexible material, and a cylinder hinge joint.

3. A shoe comprising:

(a) a sole comprising a toe portion, a heel portion, and a hinged metatarsophalangeal portion;

(b) an upper comprising a toe portion, a rear portion, a tongue under laces, and a transverse aperture extending along a metatarsophalangeal portion; and (c) a cover piece;

wherein the cover piece covers the transverse aperture and is affixed to the shoe at medial and lateral ends of the cover piece;

wherein the transverse aperture compresses without compression of the cover piece when the sole bends along the hinged metatarsophalangeal portion when transitioning from a stance phase to a swing phase.

4. The shoe of claim 3 wherein the cover piece is affixed to the toe portion of the upper.

5. The shoe of claim 3, wherein the hinged metatarsophalangeal portion comprises a hinge extending transversely across the sole selected from the group consisting of an indented crease line, a flexible material, and a cylinder hinge joint.

6. The shoe of claim 3, wherein the cover piece is configured to slide over the tongue during gait.

7. A shoe comprising:

(a) a sole comprising a toe portion, a heel portion, and a hinged metatarsophalangeal portion;

(b) an upper comprising a toe portion, a rear portion, a tongue, and a transverse aperture extending along a metatarsophalangeal portion; and (c) a cover piece;

wherein the cover piece covers the transverse aperture and is affixed to the shoe at medial and lateral ends of the cover piece;

wherein the transverse aperture compresses without compression of the cover piece when the sole bends along the hinged metatarsophalangeal portion when transitioning from a stance phase to a swing phase.

8. The shoe of claim 7, wherein the hinged metatarsophalangeal portion comprises a hinge extending transversely across the sole selected from the group consisting of an indented crease line, a flexible material, and a cylinder hinge joint.

9. The shoe of claim 7, wherein the cover piece is configured to slide over the tongue during gait.

* * * * *